United States Patent [19]

Rose, Jr.

[11] Patent Number: 4,501,361

[45] Date of Patent: Feb. 26, 1985

[54] PRINTER THIMBLE ELEMENT HOLDER

[75] Inventor: Robert D. Rose, Jr., Englewood, Colo.

[73] Assignee: Communications Packaging Corporation, Denver, Colo.

[21] Appl. No.: 575,899

[22] Filed: Feb. 1, 1984

[51] Int. Cl.[3] ..... B65D 1/36; B65D 25/10; B65D 85/30

[52] U.S. Cl. ..... 206/493; 206/303; 206/526; 206/387; 229/2.5 R; 220/339; 220/20

[58] Field of Search ..... 206/387, 493, 303, 526; 229/2.5 R; 220/339, 20

[56] References Cited

U.S. PATENT DOCUMENTS

| | | | |
|---|---|---|---|
| 3,265,280 | 8/1966 | Butzko | 229/2.5 |
| 4,341,307 | 7/1982 | Shyers | 206/387 |
| 4,407,410 | 10/1983 | Graetz et al. | 229/2.5 R |

OTHER PUBLICATIONS

IBM Bulletin, vol. 17, No. 5, Oct. 1974, *Type Font Tray,* Kerr and Harris.

*Primary Examiner*—William T. Dixson, Jr.
*Attorney, Agent, or Firm*—Gregg I. Anderson

[57] ABSTRACT

A printer thimble element storage case is disclosed having a front cover hingeably connected through a spine to a back cover. The inside of the back cover has attached thereto an element tray including a top surface spaced away from the inner surface of the cover and having a plurality of wells formed therein matable about the printer thimble elements. A spindle concentrically mounted in the bottom surface of each well securely retains the thimble elements. A top surface of the element tray is of generally rectangular configuration and slopes away from the edge thereof downwardly and toward the inner surface of the back cover, terminating in a mating surface and a stop ledge. The front cover includes, on an inner surface thereof a tray cover including a wall having an engagement edge formed thereon for receipt of the element tray. The engagement edge is adapted to mate against the sloping guide surface of the element tray on closure of the front cover adjacent to the back cover and automatically positions the tray cover to a position adjacent to the mating surface and against the stop ledge or closure. Frictional engagement between the tray cover and the mating surface keeps the book cover closed.

3 Claims, 4 Drawing Figures

PRINTER THIMBLE ELEMENT HOLDER

BACKGROUND OF THE INVENTION

1. Field of the Invention

The present invention relates to cases or binders for holding computer printer or typewriter thimble elements. More particularly, the present invention relates to cases or binders for holding several thimble elements.

2. Description of the Prior Art

Generally cylindrically-shaped thimble elements carrying alphabetic and numeric characters, as well as punctuation and other symbols, are widely utilized in computer printers and typewriters. These thimble elements are largely associated with printers manufactured by NEC (Nipon Electric Company). The thimble elements include a separate finger for each character to be typed and extend upwardly from a generally flat base. Each finger is separated by a space from the next adjacent finger, the fingers extending around the periphery of the generally cylindrical thimble for three hundred sixty degrees.

The thimble element is usually made of plastic and this fast, coupled with the orientation of the fingers, make breakage of the thimble element a very serious problem. Most computer printers have several thimble elements to accommodate various types of type and characters per inch of typing line. A given printer will have several thimble elements, which must be protected when not in use.

Another problem associated with the thimble elements is keeping them clean. By the nature of the typing or printing environment, dust does tend to collect on the thimble elements, which elements, due to the fact that all of the fingers carrying the characters extend upwardly, are even more susceptible to dust than some other type of printing elements. Keeping the elements free from dust when not in use is therefore a very real consideration in use of these thimble elements.

Two types of commercially available thimble element holders or binders exist. The first type includes a book-like cover having on one inside cover thereof a number of spindles projecting upwardly from the surface. These spindles engage the thimble element and hold the thimble element relative to the inner surface of the cover. The other cover closes against the cover that retains the thimble elements. There is a relatively low ridge or wall formed around the periphery of the portion of the cover on which the thimble elements are retained. The closing cover portion must be manually aligned with this wall to properly close and seal the thimble elements. This prior art thimble element holder does not include a well in which the thimble elements sit for protection.

A second type of commercially available thimble element storage device is a thimble binder. The thimble binder includes a thermoformed thimble element tray and a flap or cover sealable thereover. The thimble element tray includes spindles for retaining the thimble elements and wells into which the thimble elements are placed which are concentric with the spindles. The wells do not extend the full height of the thimble elements but only a portion of that height. At a height above a bottom of the tray coincident with the height of the elements, a ridge extends around the periphery of the tray. The ridge includes two Velcro corner tabs for securing a flap or cover folded over the tray.

The primary disadvantages of the prior art thimble element holders lies in the closure of the cover. The first mentioned device requires that the cover be carefully placed over the top of the thimbles, avoiding accidentally striking one of the exposed thimbles upon closure of the cover. The cover must be aligned with the ridge and snapped into place. The second mentioned cover requires that each Velcro tab be aligned and connected in the conventional manner.

OBJECTS AND SUMMARY OF THE INVENTION

It the principal object of the present invention to provide a thimble element storage device or case for storing a plurality of printer thimble elements.

It is a related object of the present invention to provide a thimble element storage device constructed from two hingeably connected cover portions, the cover portions being automatically aligned and locked upon closure of one cover against the other cover.

It is a further related object of the present invention to provide an element thimble storage device for protecting fragile printer thimble elements.

In accordance with the objects of the invention, a storage device or holder case for printer thimble elements having a front cover hingeably connected through a spine to a back cover is shown. The back cover includes integrally connected thereto a thimble element tray including spindles for holding a number of printer thimble elements. Each of the spindles defines essentially the center of a generally cylindrical well formed for general mating receipt of the thimble elements.

A top surface of the thimble element tray is coincident with a top edge of the element wells. An outer periphery of the thimble element tray tapers outwardly and away from the top surface to a frictional mating surface.

The front cover has a tray cover extending around the periphery thereof which, upon closure of the front cover to the back cover, engages the tapered guide surface guiding the tray cover into contact with the mating surface. The mating surface frictionally holds the tray cover and front cover in a closed position against the back cover and element tray.

DESCRIPTION OF THE PREFERRED EMBODIMENT

Figure 1:
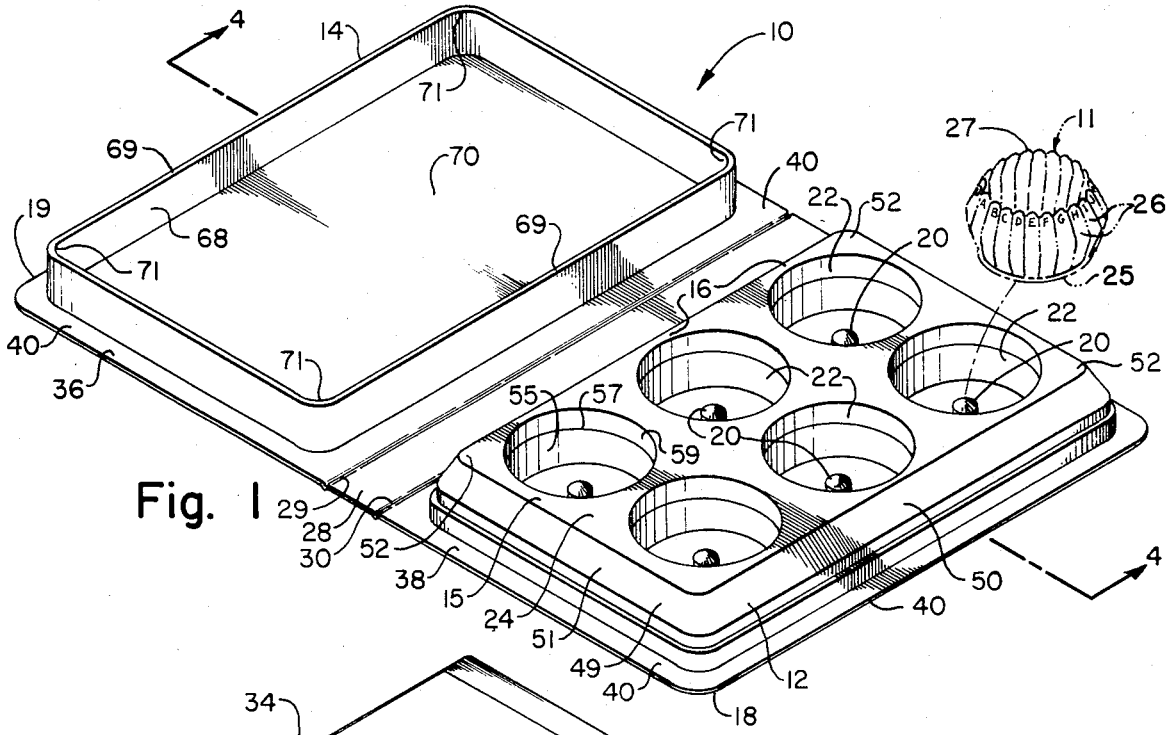
FIG. 1 is a perspective of a printer thimble element storage device or holder and a printer thimble element to be stored therein, the element holder being shown in an open position.
Figure 2:
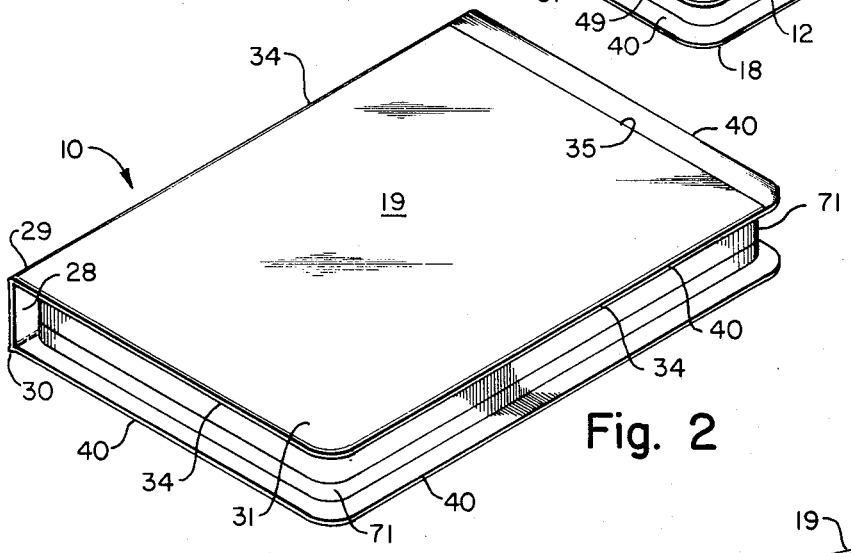
FIG. 2 is a perspective view of the invention shown in FIG. 1, the element holder being shown in a closed position.

A thimble element storage device or holder case 10 is seen in the drawing figures for holding commercially available printer thimble elements 11. In the preferred embodiment, the storage case 10 holds six printer thimble elements 11, one of such printer thimble elements 11 being shown in FIG. 1. An element tray 12 orients the elements 11 in two parallel column 15 and three parallel rows 16.

The holder 10 includes a back cover 18, to which is mounted the thimble element tray 12, and a front cover 19, to which is mounted a tray cover 14. During closure of the front cover 19 to the back cover 18, the tray cover 14 automatically aligns with and frictionally connects to the thimble element tray 12.

During the closing of the holder 10, the thimble elements 11 are protected within the thimble element tray 12. Each thimble element 11 is securely connected to a retainer spindle 20 oriented at the center of element wells 22 formed in the tray 12 along the rows 16 and columns 15 previously mentioned. Concentric with the spindles 20, the tray 12 has formed in a top surface 24 the element wells 22, which wells 22 conformably fit around the circumference and conform to the height of the generally cylindrically-shaped thimble elements 11. The tray 12 and wells 22 formed therein fully protect the thimble elements 11 when the holder 10 is open from inadvertent breakage.

Thimble elements 11 are commercially available and are the reason for the present invention, rather than the subject of it. Thimble elements 11 are of generally cylindrical configuration having a mounting hole formed in a base 25 thereof (not shown) providing means for mounting the thimble element 11 onto a printer or typewriter. The spindle 20 of the element tray 12 conforms generally to the mechanism in a printer or typewriter to which the thimble element 11 is secured. In this manner, the thimble element 11 is held on the spindle 20 during use of the holder 10.

The thimble elements 11 have separate upright fingers 26 extending upwardly from the base 25, the fingers 26 having alphabetic, numeric and other characters formed at a distal end 27. It is the protection of these fingers 26 to which a principal object of the present invention is directed.

The front cover 19 is hingeably connected through an elongated spine 28 along hinge lines 29 and 30 to the back cover 18. The front cover 19, spine 28 and back cover 18 are all cardboard pieces formed in generally rectangular configuration. The front and back covers 19 and 18 are preferably of sides of seven inches by ten inches. The front cover 19, spine 28 and back cover 18 are all covered in vinyl or cloth or the like in a conventional manner. The front cover 19 has, on an outer surface 31 thereof, a clear plastic sleeve 32 secured at three edges 34 of the front cover 19. A top edge 35 of the sleeve 32 is left free for the insertion of a identification sheets or other indicia.

The hinges 29 and 30 are formed either side of the length of the spine 28 connecting the spine 28 on one side of the front cover 19 and on the other side to the back cover 18. The hinges 29 and 30 are of conventional construction such as a continuous vinyl sheet applied to an inside surface 36 of the front cover 19 and an inside surface 38 of the back cover 18 passing across the spine 28. The vinyl is heat sealed to a second continuous sheet of vinyl placed over an outside surface 31 of the front cover 19 and an outside surface 39 of the back cover. A heat sealed edge 40 is formed around the entire periphery and the hinges 29 and 30 connect the back 18 and front covers 19 to the spine 28.

Figure 4:
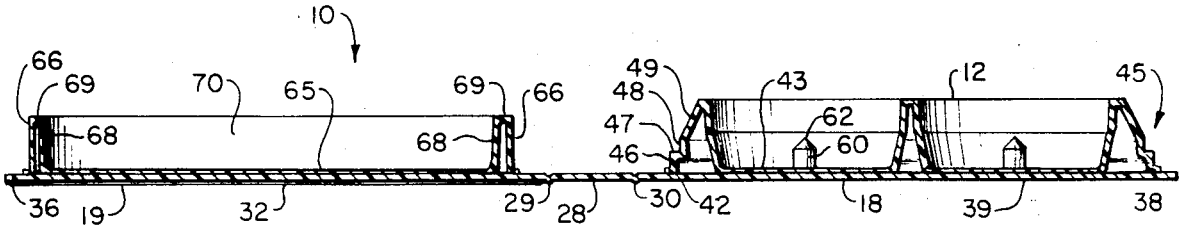
FIG. 4 is a sectional view taken in the plane of line 4—4 of FIG. 1.

The element tray 12 is molded from a single sheet of thermoformed polypropylene plastic. With reference to FIG. 4, the tray 12 includes a flat base portion 42 coplanar with a bottom surface 43 of the element wells 22. The base portion 42 and bottom surface 43 of the element wells 22 are secured, as by glueing, to the inside surface 38 of the back cover 18. A raised ledge 45 is formed around the periphery of the base portion 42 of the back cover 18. The raised ledge 45 includes a side wall 46 perpendicular to the base portion 42 and a generally horizontal stop ledge 47 extending a short distance inwardly from the periphery of the tray 12.

Extending perpendicularly upwardly a relatively short distance from the stop ledge 47 is a frictional mating surface 48 of the element tray 12. The stop ledge 47 and the mating surface 48 of the element tray 12 define a closure means in association with the tray cover 14, as will be described hereinafter. At the termination of the mating surface 48, which mating surface 48 extends completely around the periphery of the element tray 12, a smooth continuous sloping guide surface 49 projects inwardly, terminating in the top surface 24 of the tray 12.

The stop ledge 47 extends inwardly from the wall 46 of the raised ledge 45 approximately an eighth of an inch. The mating surface 48 extends perpendicularly upwardly from the stop ledge 47 for approximately an eighth of an inch. The guide surface 49 tapers inwardly along an edge 50 parallel to the columns 15, approximately one quarter of an inch, and has an overall surface length of approximately nine-sixteenths of an inch. The guide surface 49 slopes inwardly along an edge 51 parallel to the rows 16, approximately one-half of an inch and has an overall length of approximately eleven-sixteenths of an inch. The particular slopes of the portions of the guide surface 49 along the horizontal and vertical edges 50 and 51 are merged together at four rounded corners 52 of the well tray 12. The top surface 24 is therefore approximately seven and three-quarters of an inch long, by five inches wide, by an inch deep, supplying enough room to orient two, two and one-quarter inch diameter elements in the wells on a given row 16 and three of such elements along the columns 15.

The wells 22 themselves are generally cylindrical recessions formed in the top surface 29 extending to the bottom surface 43 of the well 22, which bottom surface 43 is essentially coincident with the inner surface 38 of the back cover 18. The total depth of the well 22 is therefore approximately one inch. In order to mate with thimble elements 11, the well 22 is shaped so as to have a slightly diverging surface 55 extending from the bottom well surface 42 outwardly for approximately two-thirds of the depth of the well 22. This diverging surface 55, at its termination, defines a demarcation line 57 from which a cylindrical surface 59 extends to a termination of the well 22 at the top surface 24.

The spindles 20 are formed in the bottom surface 43 of the well 22 at a central position relative to a circular cross section of the well 22. The spindles 20 are thermoformed in the base portion 42 of the tray 12 and include a short cylindrical portion 60 and an integral cone 62 mounted at the uppermost termination thereof. The spindles 20 are approximately three-eighths of an inch high. As previously mentioned, the spindles 20 receive the thimble elements 11 in a frictional fit, retaining the thimble elements 11 in the wells 22 adjacent to the bottom surface 43 and in a mated relationship around their circumference with the divering 55 and cylindrical surfaces 59.

The inside surface 36 of the front cover 19 has attached thereto the tray cover 14. The tray cover 14 is also formed from thermoformed plastic and includes a base portion 65 connected to the inside surface 36 of the front cover 19. From the base portion 65 extends upwardly an outer wall 66 and an inner wall 68 defining therebetween an engagement ledge 69. A rectangular recess 70 is defined therebetween. The outer periphery of the tray cover 14 includes four rounded corners 71. The outer wall 66 of the tray cover 14 has height and width dimensions corresponding to those of the raised ledge 45 of the element tray 12. The engagement edge 69 is of approximately the same width as the stop ledge 47. The inner wall 68 is dimensioned so as to be approximately the same as the dimensions of the mating surface 48 of the element tray 12.

Figure 3:
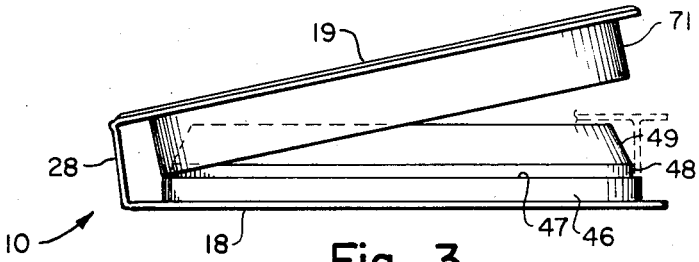
FIG. 3 is a side elevational view of the invention shown in FIG. 1, a front cover being shown closing against a back cover in phantom lines.

Closure of the front cover 19 to the back cover 18 (see FIG. 3) is accomplished as one would close a book. Once the elements 11 are placed on the spindles 20 of the elements wells 22, the front cover 19 is pivoted about the hinges 29 and 30 of the spine 28 toward the back cover 18. The engagement edge 69 of the tray cover 14, no matter how loose the hinge connections 29 and 30 become, will be guided by the top surface 24 and sloping guide surface 49 to a position wherein the engagement edge 69 is mated against the stop ledge 47. The inner wall 68 of the tray cover 14 will be frictionally held by the mating surface 48, holding the tray cover 14 and front cover 19 closed, protecting the fragile elements 11.

Although the present invention has been described with a certain degree of particularity, nothing contained herein shall serve to limit the scope of the invention as defined by the appended claims.

What is claimed is:

1. A storage case for thimble elements used in printing devices comprising in combination:

a front cover hingeably connected through a spine to a back cover, said back cover having a flat inner surface on which said inner surface is connected a thimble element tray including a plurality of upwardly directed spindles formed in rows and columns thereon for releasably retaining and protecting therein at least one of said thimbles, each of said spindles formed about a longitudinal axis, an open element well associated with each of the spindles having a circular bottom surface formed in a generally flat planar top surface of said tray concentric with said spindle axis, each of said wells including a slightly diverging surface extending upwardly away therefrom and a cylindrical surface, said well adapted to matingly conform to the thimble elements, said cylindrical surface terminating at said top surface, an outer periphery of said top surface terminating in a continuous sloping guide surface extending outwardly and downwardly from said top surface around the periphery of the top surface, the guide surface defining an angle of approximately fifty-five degrees with said flat inner surface and terminating in a mating surface and a stop ledge extending completely around the periphery of said tray, said front cover having an inner surface on which is connected a tray cover defined by an outside and inside wall extending upwardly therefrom and interconnected by an engagement ledge, said tray cover defining a recess for receipt of said element tray, said edge of said tray cover adapted to engage said element tray guide surface upon closure of said tray cover over said tray, thereby automatically aligning the front cover relative to the back cover on closure of the case.

2. The invention as defined in claim 1 wherein said wells are oriented in two vertical columns and three horizontal rows formed in said tray.

3. The invention as defined in claim 1 wherein said top surface is of sufficient length, width and depth to have six wells oriented in rows and columns, said depth being the same as the height of the elements.

* * * * *